US007574171B2

(12) United States Patent
Park et al.

(10) Patent No.: US 7,574,171 B2
(45) Date of Patent: Aug. 11, 2009

(54) METHOD FOR PROVIDING INFORMATION REGARDING SERVICE LINKING BETWEEN TERRESTRIAL AND SATELLITE DMB SYSTEMS AND METHOD FOR SWITCHING SERVICES BY USING SERVICE LINKING INFORMATION IN DMB TERMINAL

(75) Inventors: Joon-Ho Park, Suwon-si (KR); Young-Jip Kim, Suwon-si (KR); Jeong-Sik Cho, Suwon-si (KR); Sun-Mi Kim, Seoul (KR)

(73) Assignee: Samsung Electronics Co., Ltd., Maetan-Dong, Yeongtong-Gu, Suwon-Si, Gyeonggi-Do (KR)

( * ) Notice: Subject to any disclaimer, the term of this patent is extended or adjusted under 35 U.S.C. 154(b) by 489 days.

(21) Appl. No.: 11/514,437

(22) Filed: Sep. 1, 2006

(65) Prior Publication Data

US 2007/0111658 A1 May 17, 2007

(30) Foreign Application Priority Data

Sep. 5, 2005 (KR) ..... 10-2005-0082311

(51) Int. Cl.
*H04H 40/00* (2008.01)

(52) U.S. Cl. ..... 455/3.06; 725/56

(58) Field of Classification Search ..... 455/3.06, 455/3.02; 348/180, 211.2, 211.3, 211.1; 725/49, 56, 62, 63
See application file for complete search history.

(56) References Cited

U.S. PATENT DOCUMENTS 6,741,834 B1 5/2004 Godwin ..... 455/3.01
2003/0003899 A1 1/2003 Tashiro et al.

FOREIGN PATENT DOCUMENTS

| | | |
|---|---|---|
| JP | 07-500710 | 1/1995 |
| JP | 08-275077 | 10/1996 |
| JP | 08-314979 | 11/1996 |
| JP | 10-262193 | 9/1998 |
| JP | 10-512420 | 11/1998 |
| JP | 10-327110 | 12/1998 |
| JP | 11-008810 | 1/1999 |
| JP | 11-317914 | 11/1999 |
| JP | 2000-101946 | 4/2000 |

(Continued)

*Primary Examiner*—Tu X Nguyen
(74) *Attorney, Agent, or Firm*—Cha & Reiter, LLC

(57) ABSTRACT

Disclosed is a method for providing information regarding service linking between a terrestrial DMB system and a satellite DMB system by using a service linking information provision server for creating and providing service linking information between the terrestrial DMB system and the satellite DMB system in a broadcasting having the terrestrial DMB system, the satellite DMB system, and a mobile communication system. The method includes the steps of (a) receiving EPG information from the terrestrial DMB system and the satellite DMB system, respectively, by the service linking information provision server; (b) analyzing content of the EPG information and confirming existence of a linked service; (c) classifying service linking according to degree of linking, when the existence of a linked service is confirmed, and storing resultant classification information as service linking information; and (d) providing the service linking information via the mobile communication system when a request for the service linking information is received from a DMB receiver terminal.

5 Claims, 7 Drawing Sheets

FOREIGN PATENT DOCUMENTS

| | | |
|---|---|---|
| JP | 2000-115653 | 4/2000 |
| JP | 2001-008119 | 1/2001 |
| JP | 2003-018108 | 1/2003 |
| JP | 2004-503129 | 1/2004 |
| JP | 2004-527155 | 9/2004 |
| JP | 2004-336694 | 11/2004 |
| JP | 2004/538725 | 12/2004 |
| WO | WO 99/35849 | 7/1999 |
| WO | WO 01/56271 | 8/2001 |

(a)

| SBS | |
|---|---|
| TIME | BROADCAST |
| 10:00 ~11:00 | SBS NEWS |
| 11:00 ~14:00 | CHAN-HO PARK STARTING THE GAME |
| 14:00 ~15:00 | SBS SOAP OPERA |
| 15:00 ~16:00 | SBS MOVIE EXPRESS |

301

(b)

| Xsprts | |
|---|---|
| TIME | BROADCAST |
| 9:00 ~10:00 | TODAY'S SPORTS |
| 10:00 ~11:00 | WWF WRESTLING |
| 11:00 ~14:00 | CHAN-HO PARK STARTING THE GAME |

302

FIG.3

METHOD FOR PROVIDING INFORMATION REGARDING SERVICE LINKING BETWEEN TERRESTRIAL AND SATELLITE DMB SYSTEMS AND METHOD FOR SWITCHING SERVICES BY USING SERVICE LINKING INFORMATION IN DMB TERMINAL

CLAIM OF PRIORITY

This application claims priority to an application entitled "Method for Providing Information Regarding Service Linking Between Terrestrial and Satellite DMB Systems and Method for Switching Services by Using Service Linking Information in DMB Terminal," filed with the Korean Intellectual Property Office on Sep. 5, 2005 and assigned Serial No. 2005-82311, the contents of which are incorporated herein by reference.

BACKGROUND OF THE INVENTION

1. Field of the Invention

The present invention relates to a Digital Multimedia Broadcasting (DMB) service, and more particularly to a method for providing information regarding service linking between satellite and terrestrial DMB systems.

2. Description of the Related Art

As generally known in the art, DMB provides portable or vehicular receivers with various multimedia signals, including audio and video signals, in a digital mode. The DMB is classified into satellite DMB and terrestrial DMB according to the transmission means. The satellite DMB provides DMB terminals with programs via satellite waves on a nationwide basis. The terrestrial DMB provides broadcasts via sky wave VHF channel nos. 12 and 8.

Although the satellite DMB is currently incompatible with the terrestrial DMB, it is expected in the near future that a single receiver terminal will be able to receive both satellite and terrestrial DMB services. DMB receiver terminals incorporate the functions of mobile communication terminals.

FIG. 1 illustrates a conventional DMB receiver terminal for receiving services from a number of systems.

Referring to FIG. 1, the DMB receiver terminal 100 is connected to a mobile communication system 11 (e.g. WiBro), which supports wireless data communication, a terrestrial DMB system 12, and a satellite DMB system 13 so as to receive corresponding services from each of them.

In order to receive DMB services from the terrestrial DMB system 12 and satellite DMB system 13, as illustrated in FIG. 1, the DMB receiver terminal 100 is provided with an EPG (Electronic Program Guide), which contains information regarding broadcasts available from each broadcasting system.

Particularly, each broadcasting service has its own EPG.

Therefore, in order to receive all broadcasting services via a single DMB receiver terminal 100, the EPG of the terrestrial DMB system 12 must be combined with that of the satellite DMB system 13 so that a unified service can be provided based on similarity among programs.

In the case of a DMB service, the mobility of a service subscriber frequently affects the quality of service among broadcasting systems. Suppose that a service subscriber is on the move: signals from the terrestrial DMB system 12, which has been providing a service to the subscriber, gradually weaken until the service is no longer provided. However, signals from the satellite DMB system 13 may be strong enough to provide a normal service at another place, or vice versa.

If the subscriber has been watching a program, the subscriber would want to watch it without interruption, even through the subscriber is on the move. This requires a method for switching from the terrestrial DMB 12 to the satellite DMB 13 and seamlessly connecting to a corresponding program being broadcast by the satellite DMB 13.

Conventionally, each DMB system 12 and 13 provides the DMB receiver terminal 100 with its own EPG, which contains programming information. However, currently there is no correlation between EPGs of the different DMB broadcasting systems 12 and 13.

When the DMB receiver terminal 100 can no longer receive a program from the terrestrial DMB system 12 for some reasons that is being watched by the service subscriber, and the subscriber and wants to receive a corresponding program from the satellite DMB system 13, the terminal must determine if the corresponding program is available from the satellite DMB system 13 and search for channel information.

Therefore, a method is needed for efficiently linking programs of the terrestrial and satellite DMB systems 12 and 13 so that corresponding services from both systems can be identified and switching between services can be accomplished so that services can be received from both systems.

SUMMARY OF THE INVENTION

Accordingly, the present invention provides a method for providing information regarding service linking between terrestrial and satellite DMB systems so that a DMB receiver terminal, which can receive both satellite and terrestrial DMB services, is provided with the service linking information, which is separate from EPGs provided by the DMB systems. In a preferred embodiment, this service linking information is provided via a mobile communication network, in order to improve the efficiency of searching a number of programs from various broadcasting stations and includes a correlation among the programs along with a means for switching services by using the provided service linking information in the DMB receiver terminal.

In one embodiment, a method provides information regarding service linking between a terrestrial DMB system and a satellite DMB system by using a service linking information provision server for creating and providing service linking information between the terrestrial DMB system and the satellite DMB system in a broadcasting system comprising the terrestrial DMB system, the satellite DMB system, and a mobile communication system. The method includes the steps of:

(a) receiving an EPG information content from each of the terrestrial DMB system and the satellite DMB system by the service linking information provision server;

(b) analyzing by the server the content of the EPG information and determining existence of a linked service;

(c) classifying service linking by the server in accordance with the degree of linking, when the existence of a linked service is determined, (d) storing by the server resultant classification information as service linking information; and (e) providing by the server the service linking information via the mobile communication system when a request for the service linking information is received by the server from a DMB receiver terminal.

In accordance with another aspect of the present invention, there is provided a method for switching services by using service linking information in a DMB receiver terminal adapted to receive services from a terrestrial DMB system and a satellite DMB system, the method including the steps of:

(a) receiving a satellite DMB signal and a terrestrial DMB signal by the DMB terminal;

(b) outputting a first broadcast received from one of the satellite DMB system and the terrestrial DMB system by the DMB receiver terminal;

(c) measuring by the DMB receiver terminal reception sensitivity regarding the first broadcast;

(d) comparing by the DMB receiver terminal the measured reception sensitivity regarding the first broadcast with a preset reception sensitivity critical value;

(e) when the reception sensitivity regarding the first broadcast is less than the reception sensitivity critical value, requesting by the DMB receiver terminal service linking information regarding existence of a second broadcast in a DMB system not providing the first broadcast, the second broadcast being linked with the first broadcast;

(f) receiving by the DMB receiver terminal the requested service linking information;

(g) when the second broadcast exists, measuring by the DMB receiver terminal a reception sensitivity regarding the second broadcast;

(h) determining by the DMB receiver terminal a highest reception sensitivity between the measured reception sensitivity regarding the first broadcast and the measured reception sensitivity regarding the second broadcast; and (i) playing a broadcast having the determined higher reception sensitivity.

BRIEF DESCRIPTION OF THE DRAWINGS

The above and other features, and advantages of the present invention will be more apparent from the following detailed description taken in conjunction with the accompanying drawings, in which:

FIG. 3 (*a*) illustrates an example of EPG information of a satellite DMB system and FIG. 3(*b*) illustrates an example of EPG information of a terrestrial DMB system, according to an embodiment of the present invention;

DETAILED DESCRIPTION OF THE INVENTION

Hereinafter, embodiments of the present invention will be described with reference to the accompanying drawings. For the purposes of clarity and simplicity, a detailed description of known functions and configurations incorporated herein is omitted to avoid making the subject matter of the present invention unclear.

Figure 1:
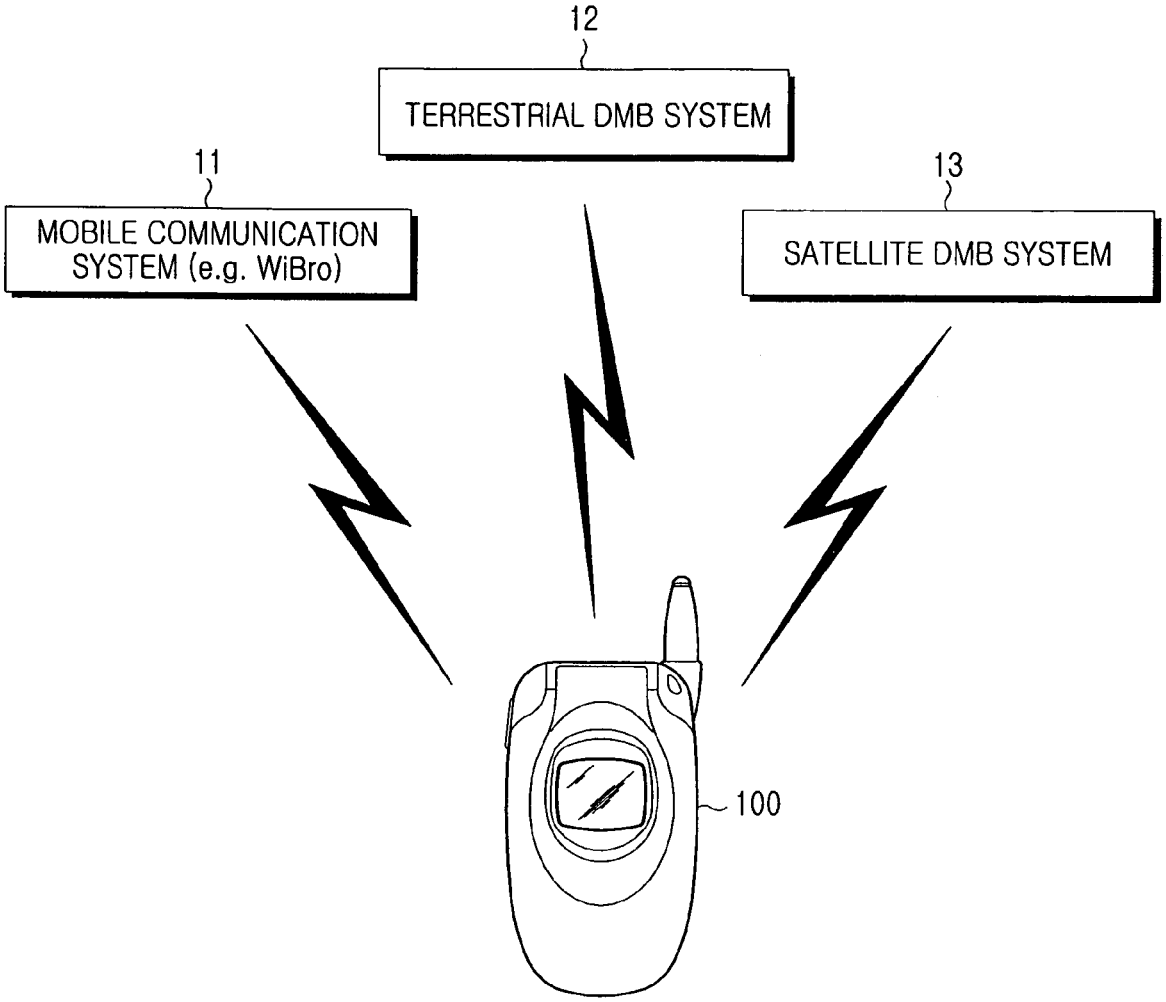
FIG.1 (PRIOR ART)
FIG. 1 illustrates a conventional DMB receiver terminal for receiving services from a number of systems.
Figure 2:
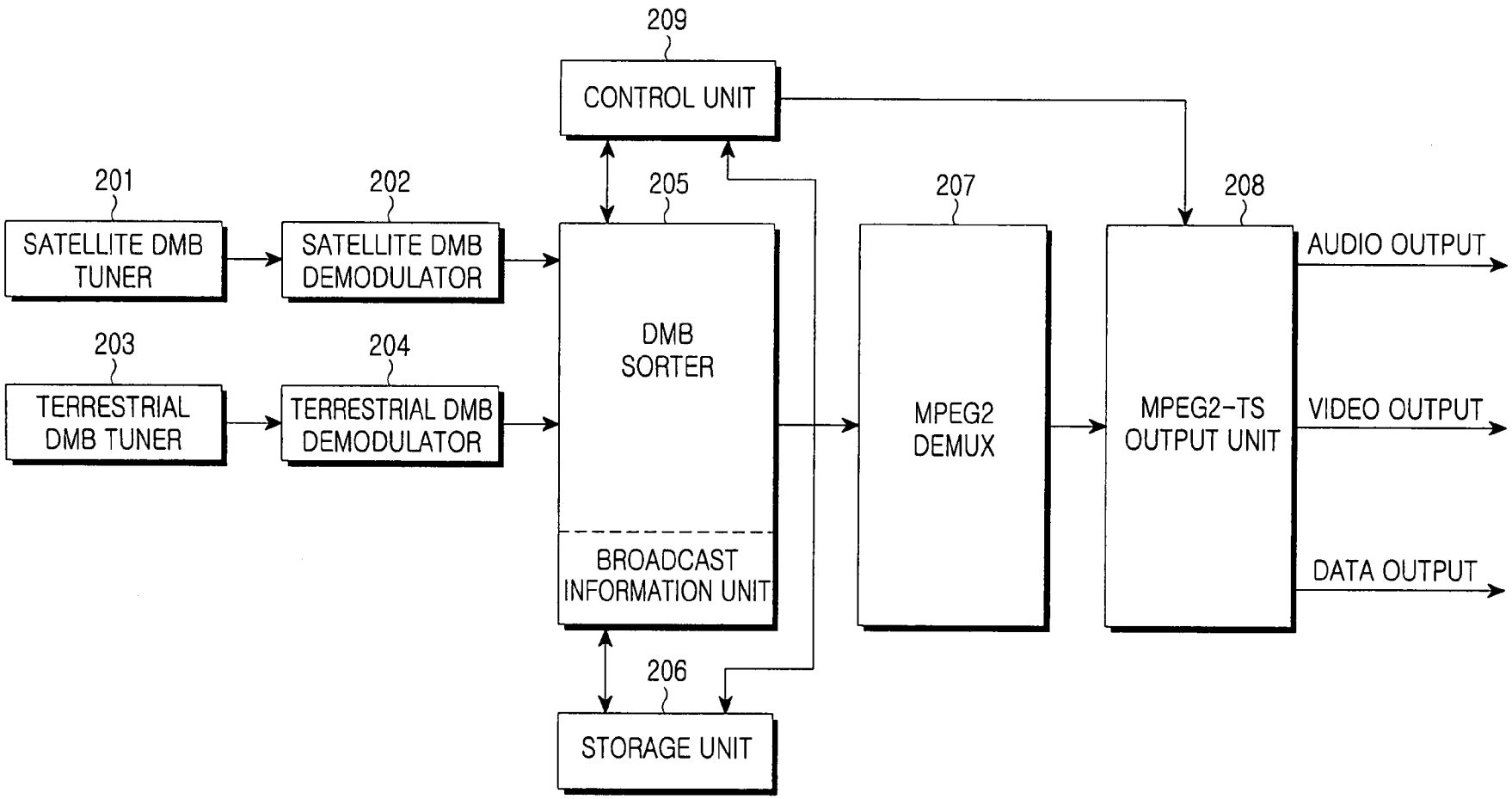
FIG. 2 illustrates an architecture of a dual-mode DMB terminal capable of receiving both satellite and terrestrial DMB services, according to an embodiment of the present invention.

FIG. 2 illustrates an architecture of a dual-mode DMB terminal capable of receiving both satellite and terrestrial DMB services according to an embodiment of the present invention.

Referring to FIG. 2, the dual-mode DMB terminal according to an embodiment of the present invention includes a satellite DMB tuner 201 for selecting a channel of a desired satellite DMB frequency and receiving DMB signals of that frequency; a satellite DMB demodulator 202 for demodulating the DMB signals received by the satellite DMB tuner 201 and outputting a first resultant MPEG2-TS to the DMB sorter 205 (described below); a terrestrial DMB tuner 203 for selecting an ensemble of a desired terrestrial DMB frequency and receiving DMB signals of that frequency; a terrestrial DMB demodulator 204 for demodulating the DMB signals received by the terrestrial DMB tuner 203 and outputting a second resultant MPEG2-TS to the DMB sorter 205; a DMB sorter 205 for receiving the first and second resultant MPEG2-TSs from the satellite and terrestrial DMB demodulators 202 and 204, respectively, switching them based on the user's selection, and outputting them to at least one of a broadcast information display unit and an MPEG2-TS output unit; a storage unit 206 for receiving and storing the first or second MPEG2-TS, which has been sorted by the DMB sorter 205; an MPEG2 demux 207 for receiving the first or second MPEG2-TS from the DMB sorter 205 and demuxing it; an MPEG2-TS output unit 208 for decoding first or second MPEG2-TS data, which has been demuxed by the MPEG2 demux 207; and a control unit 209 for transmitting information regarding the user's selection to the DMB sorter 205, controlling it so as to perform a switching operation, and transmitting information regarding a decoding mode, based on the switching operation, to the MPEG2-TS output unit 208.

As such, the DMB receiver terminal, according to the present embodiment of the present invention, can receive the terrestrial and satellite DMB services. Particularly, the terminal has both terrestrial and satellite DMB tuners and selectively operates the decoder 208 based on the type of received broadcasts, so that a user is provided with desired broadcasts.

FIG. 3 illustrates an example of EPG information of satellite and terrestrial DMB systems, according to an embodiment of the present invention.

In FIGS. 3, (*a*) and (*b*) correspond to EPG information of terrestrial and satellite DMB services, respectively, according to the present invention.

It is clear from FIG. 3 that a broadcast entitled "Chan-Ho Park starting the game" 301 and 302 is on the air at 11:00-14:00 from both broadcasting systems. In order to watch the broadcast without interruption, switching operation between the broadcasting systems may be necessary which switching requires linking information for the broadcast.

Figure 6:
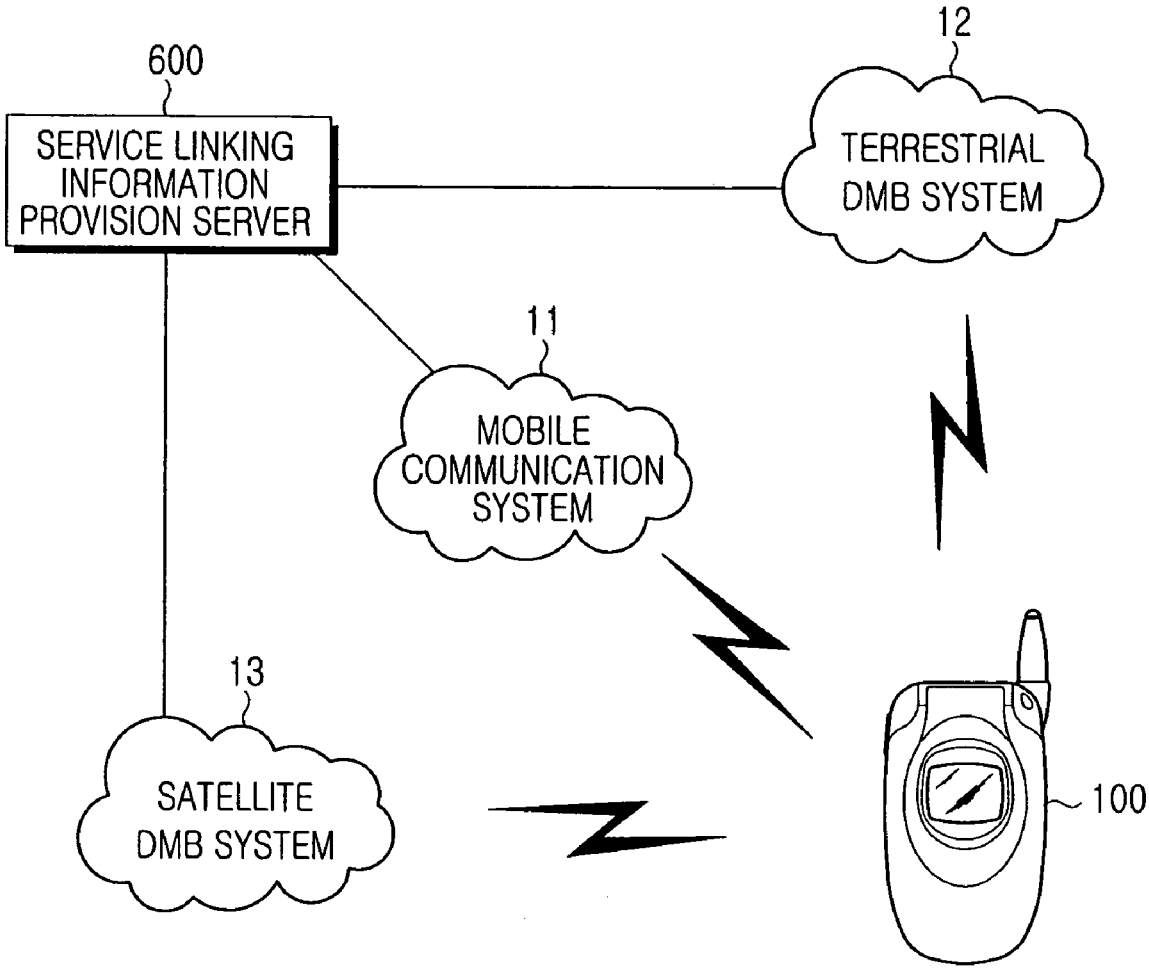
FIG. 6 illustrates an architecture of a linking information provision system for providing information regarding linking between DMB services, according to an embodiment of the present invention.

FIG. 6 illustrates an architecture of a linking information provision system for providing information regarding linking between DMB services according to an embodiment of the present invention.

Referring to FIG. 6, the linking information provision system for providing information regarding linking between DMB services according to an embodiment of the present invention includes a mobile communication system 11 for providing wireless communication; a terrestrial DMB system 12 for providing terrestrial DMB services; a satellite DMB system 13 for providing satellite DMB services; and a service linking information provision server 600 for receiving EPG information from the terrestrial and satellite DMB systems 12 and 13, respectively, analyzing the EPG information, creating linking information for each program, and providing the linking information via the mobile communication system 11 to a DMB receiver terminal 100.

The DMB receiver terminal 100 is connected to the mobile communication system 11 (e.g. WiBro) which supports wireless data communication, the terrestrial DMB system 12, and the satellite DMB system 13, and receives corresponding services from them.

Figure 4:
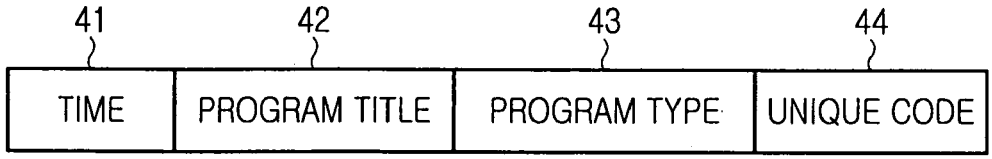
FIG. 4 illustrates the structure of EPG information transmitted from broadcasting systems in order to create service linking information, according to the present invention.

FIG. 4 illustrates the structure of EPG information transmitted from broadcasting systems in order to create service linking information according to the present invention.

Referring to FIG. 4, EPG information transmitted from broadcasting systems in order to create service linking information, according to the present invention, includes a time field 41 for indicating the broadcasting time, a program title field 42 for indicating the title of provided broadcasts, a program type field 43 for indicating the type of broadcasts, and a unique code field 44 for providing independent identifiers of corresponding programs.

The satellite and terrestrial DMB systems have different sets of EPG information. However, the information shown in FIG. 4 is essential to any type of EPG information and is included in each EPG information set of both systems. Therefore, in order to construct service linking information, the service linking information provision server 600 must extract essential fields of information, as shown in FIG. 4, from received EPG information. Then, the extracted information is used to create information regarding linking between services.

Figure 5:
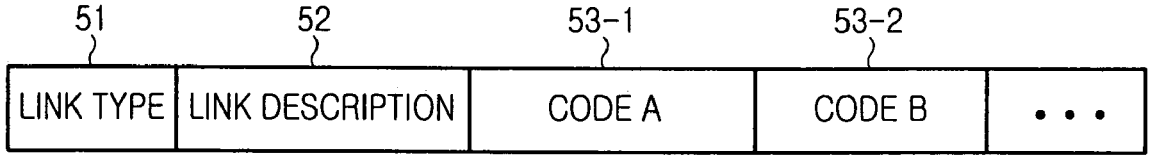
FIG. 5 illustrates the structure of service linking information provided to a DMB receiver terminal, according to an embodiment of the present invention.

FIG. 5 illustrates the structure of service linking information provided to a DMB receiver terminal, according to an embodiment of the present invention.

Referring to FIG. 5, service linking information provided to a DMB receiver terminal, according to an embodiment of the present invention, includes a link type field 51 for specifying the type of linking between broadcasts, a link description field 52 for describing information regarding a specific link type, and fields of codes A and B 53-1 and 53-2 for indicating unique values of linked broadcasts.

An example of the link type field 51 and the link description field 52 is given in Table 1.

TABLE 1

| Link type | Link description |
|---|---|
| 0x00000001 | Same program |
| 0x00000002 | Same genre |
| 0x00000003 | Similar genre |
| 0x00000010 | Programs in the same series |
| 0x00000011 | Program (code B) next to program on the air from code A in a series |
| 0x000FFFF | Program (code B) introduced on the air from code A |
| 0x000FFFF | Data program (code B) introduced on the air from code A |

Figure 7:
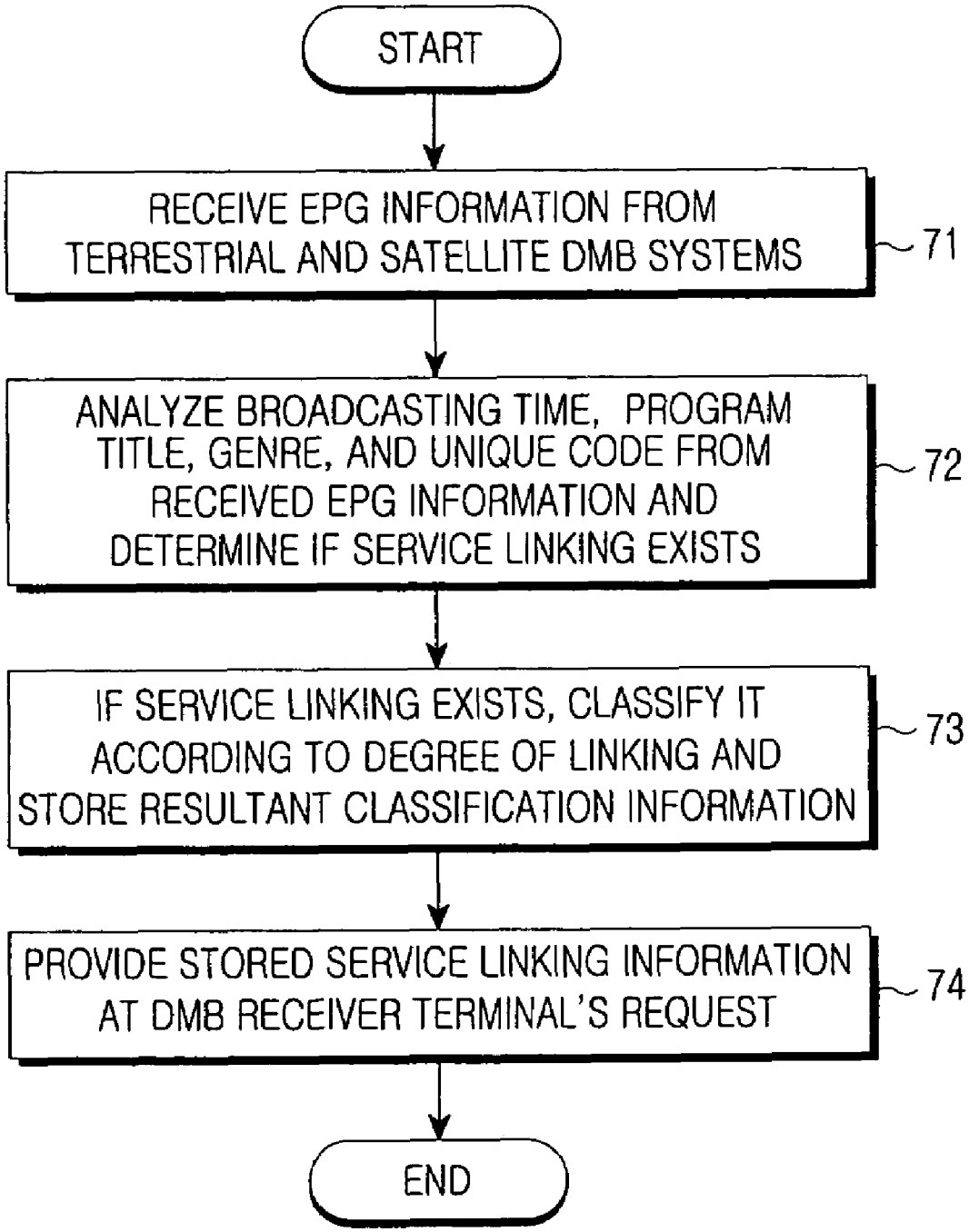
FIG. 7 illustrates a flowchart of a method for providing information regarding service linking between terrestrial and satellite DMB systems, according to an embodiment of the present invention, particularly a series of steps for providing service linking information by a service linking information provision server.

FIG. 7 illustrates a flowchart of a method for providing information regarding service linking between terrestrial and satellite DMB systems, according to an embodiment of the present invention.

Referring to FIG. 7, the service linking information provision server 600 receives EPG information from the terrestrial and satellite DMB systems, respectively, at step 71.

From each EPG information, the broadcasting time, program title, genre, and unique code are analyzed, and it is determined if linked services exist at step 72.

If service linking is determined to exist, it is assigned a resultant classification according to the degree of linking, and the resultant classification information is stored as service linking information at step 73.

When a request for service linking information is received from the DMB receiver terminal 100, the stored service linking information is provided via the mobile communication system 13 at step 74.

Figure 8:
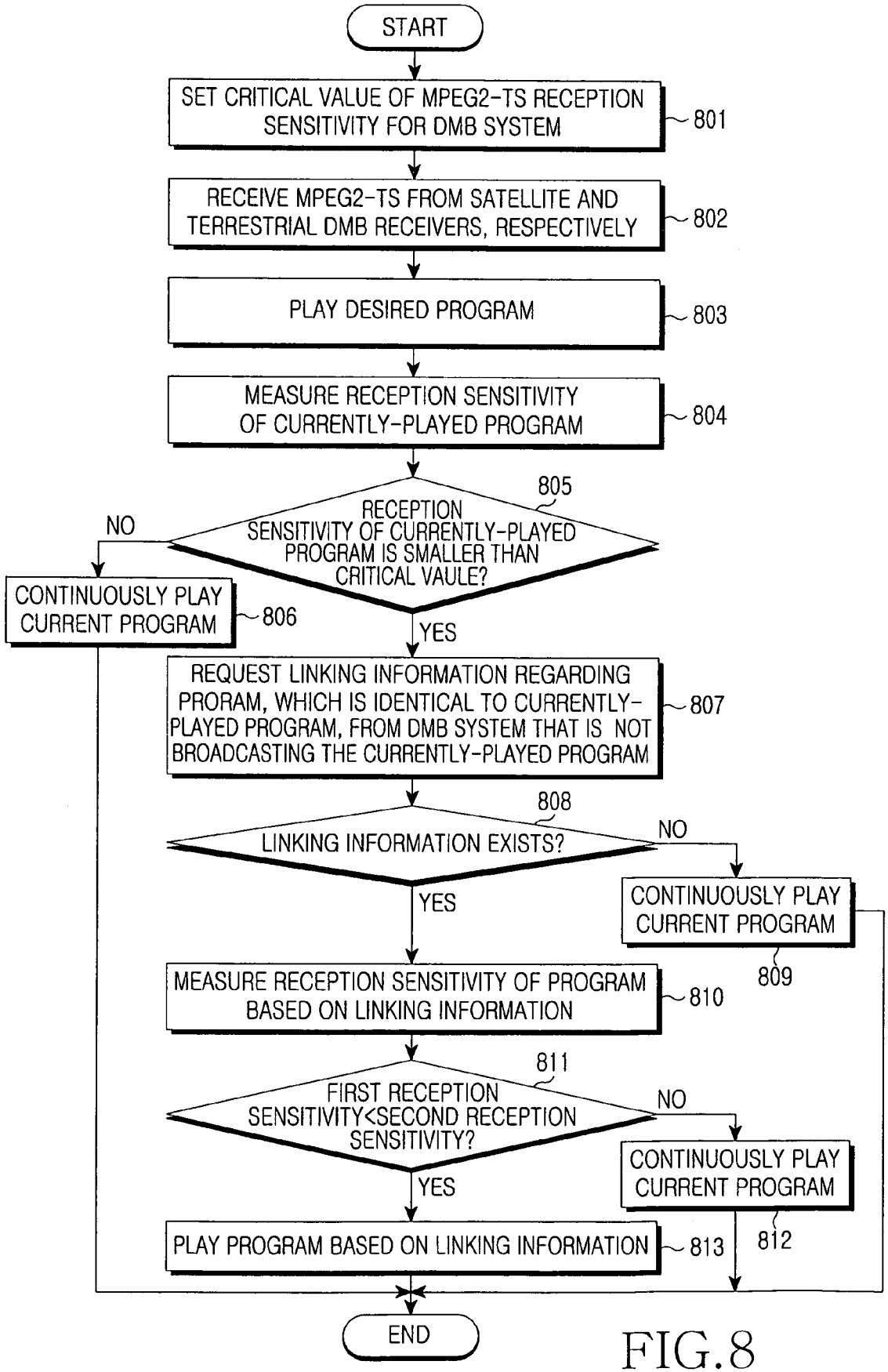
FIG. 8 illustrates a flowchart of a control method for providing an optimum service based on information regarding linking between satellite and terrestrial DMB services in a DMB receiver terminal, according to an embodiment of the present invention.

FIG. 8 illustrates a flowchart of a method for switching services by using service linking information in a DMB terminal, according to an embodiment of the present invention.

Referring to FIG. 8, a critical value of reception sensitivity regarding MPEG2-TSs of the terrestrial and satellite DMB systems 12 and 13 is set for the DMB receiver terminal 100 at step 801. The critical value may be selected by the user or preset by the terminal manufacturer.

When, at step 802, the DMB sorter 205 receives first and second MPEG2-TSs from the satellite and terrestrial DMB receivers, respectively, the control unit 209 plays a program broadcast by a user-specified DMB system at step 803.

The control unit 209 measures the reception sensitivity of the program, which is currently being played at step 804.

If, at step 805, it is determined that the measured reception sensitivity of the currently-played program is smaller than the critical value, which has been set for the DMB terminal, at step 807 the control unit 209 requests a DMB system, from which the currently-played program is not being broadcast, to provide linking information regarding the existence of a program identical to the currently-played program. The request for linking information is transmitted to the service linking information provision server 600 via the mobile communication system 13.

When a request for linking information is received by the server 600, at step 808 it is determined if there is linking information regarding a program identical to the currently-played program. If there is linking information, the control unit 209 measures the second reception sensitivity of the linked program based on the linking information at step 810.

The second reception sensitivity of the linked program based on the linking information is compared with the first reception sensitivity of the currently-played program at step 811.

If it is determined from the comparison that the first reception sensitivity is smaller than the second reception sensitivity, the control unit 209 plays the linked program based on the linking information. Particularly, at step 813 the control unit 209 plays the linked program, which is identical to the currently-played program, received from a DMB system which is not broadcasting the currently-played program. If it is determined from the comparison that the second reception sensitivity is smaller at step 811, the control unit 209 continuously plays the current program at step 812.

According to the inventive method of a preferred embodiment, the DMB receiver terminal is controlled by using linking information in the following manner: it is assumed that a user on the move is watching a currently-played program broadcast by a DMB system, and the same program is available from both satellite and terrestrial DMB systems at the same time. The control unit 209 measures the reception sensitivity of the currently-played program. If the measured reception sensitivity is smaller than a critical value preset for the DMB terminal, the control unit 209 searches for linking information regarding an other program that is identical to the currently-played program, from an other DMB system than the system that is broadcasting the currently-played program. The control unit 209 measures the reception sensitivity of the another program based on the linking information. Based on the result of measurement, the control unit 209 maintains or replaces the current broadcasting system so that the user can watch the current program without interruption.

An example of using this method illustrated in FIG. 8 will now be described with reference to the service linking information illustrated in FIG. 3. It is assumed that a user of a DMB terminal is on the move, which can receive both satellite and terrestrial DMB services, is watching a broadcast entitled "Chan-Ho Park starting the game" 301 from the satellite DMB system. The control unit 209 measures a first reception sensitivity of the currently-played program at step 804.

If, at step 805, it is determined that the first reception sensitivity of the currently-played program is smaller than a critical value, which has been set for the DMB terminal, the control unit 209 requests service linking information at step 807. If the control unit 209 cannot find service linking information regarding a corresponding program, the control unit 209 continuously plays the current program at step 809.

If, at steps 810-811), the control unit 209 finds a corresponding program 301 from the terrestrial DMB system 12, the control unit 209 measures the reception sensitivity of the program from the terrestrial DMB system 12 and compares it with the first reception sensitivity. Based on the result of comparison, a program having higher reception sensitivity is received under the control of the control unit 209 at step 813 if the corresponding program from the terrestrial DMB system has a higher reception sensitivity and otherwise continuously plays the current program at step 812.

The above-mentioned method according to the present invention can be stored on a recording medium (e.g. CDROM, RAM, floppy disk, hard disk, magneto-optical disk) as a computer-readable program.

As mentioned above, the present invention is advantageous in that it enables a user of a DMB receiver terminal, which can receive broadcasts from both terrestrial and satellite DMB systems, to watch a desired broadcast without interruption, even when the user is on the move, by using service linking information.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A method for providing information regarding service linking between a terrestrial DMB system and a satellite DMB system by using a service linking information provision server for creating and providing service linking information between the terrestrial DMB system and the satellite DMB system in a broadcasting system including the terrestrial DMB system, the satellite DMB system, and a mobile communication system, the method comprising the steps of:

(a) receiving EPG information from the terrestrial DMB system and the satellite DMB system, by the service linking information provision server;

(b) analyzing, by the server, a content of the EPG information and determining existence of a linked service;

(c) classifying with a resultant classification information, by the server, the linked service according to a degree of linking, when the existence of a linked service is determined;

(d) storing, by the server, the resultant classification information as service linking information at the server; and (e) providing the service linking information via the mobile communication system when a request for the service linking information is received from a DMB receiver terminal.

2. The method as claimed in claim 1, wherein the content of the EPG information in step (b) comprises:

a time field for indicating broadcasting time;

a program title field for indicating a title of a provided broadcast;

a program type field for indicating a type of a program; and a unique code field for providing an independent identifier of a corresponding program.

3. The method as claimed in claim 1, wherein the service linking information provided in step (e) comprises:

a link type field for specifying a type of linking between broadcasts;

a link description field for describing information regarding a link type specified by the link type field; and a plurality of code fields for indicating unique code values of linked programs.

4. A method for switching services by using service linking information in a DMB receiver terminal adapted to receive services from a terrestrial DMB system and a satellite DMB system, the method comprising the steps of:

(a) receiving, by the DMB receiver terminal, a satellite DMB signal and a terrestrial DMB signal;

(b) outputting, by the DMB receiver terminal, a first broadcast based on one of the satellite DMB system signal and the terrestrial DMB system signal;

(c) measuring, by the DMB receiver terminal, reception sensitivity regarding the first broadcast;

(d) comparing the reception sensitivity regarding the first broadcast with a preset reception sensitivity critical value to obtain a comparison result;

(e) when the comparison result is that the reception sensitivity regarding the first broadcast is smaller than the preset reception sensitivity critical value, the DMB receiver terminal requesting service linking information regarding existence of a second broadcast by a DMB system not broadcasting the first broadcast, the second broadcast being linked with the first broadcast;

(f) receiving, by the DMB receiver terminal, the requested service linking information;

(g) when the received service linking information indicates that the second broadcast exists, the DMB receiver terminal performing the steps of (f.1) measuring reception sensitivity regarding the second broadcast, (f.2) comparing the reception sensitivity regarding the first broadcast with the reception sensitivity regarding the second broadcast, and (f.3) playing a broadcast having higher reception sensitivity selected from the group consisting of the first broadcast and the second broadcast.

5. The method as claimed in claim 4, wherein the received service linking information comprises:

a link type field for specifying a type of linking between broadcasts;

a link description field for describing information regarding a link type specified by the link type field; and a number of code fields for indicating unique code values of linked programs.

* * * * *